United States Patent [19]

McCollum et al.

[11] 3,988,238

[45] Oct. 26, 1976

[54] PROCESS FOR RECOVERING UPGRADED PRODUCTS FROM COAL

[75] Inventors: John D. McCollum, Munster, Ind.; Leonard M. Quick, Naperville, Ill.

[73] Assignee: Standard Oil Company (Indiana), Chicago, Ill.

[22] Filed: July 1, 1974

[21] Appl. No.: 484,593

[52] U.S. Cl. ..... 208/9

[51] Int. Cl.[2] ..... C10G 1/04

[58] Field of Search ..... 208/8, 9, 11

[56] References Cited

UNITED STATES PATENTS

| | | | |
|---|---|---|---|
| 3,558,468 | 1/1971 | Wise | 208/8 |
| 3,586,621 | 6/1971 | Pitchford et al. | 208/214 |
| 3,642,607 | 2/1972 | Seitzer | 208/8 |
| 3,660,269 | 5/1972 | McCauley | 208/8 |
| 3,687,838 | 8/1972 | Seitzer | 208/9 |
| 3,745,108 | 7/1973 | Schuman et al. | 208/10 |
| 3,819,506 | 6/1974 | Seitzer | 208/8 |
| 3,850,738 | 11/1974 | Stewart et al. | 208/8 |

FOREIGN PATENTS OR APPLICATIONS

| | | | |
|---|---|---|---|
| 339,317 | 12/1930 | United Kingdom | 208/8 |

*Primary Examiner*—Delbert E. Gantz
*Assistant Examiner*—James W. Hellwege
*Attorney, Agent, or Firm*—James L. Wilson; Arthur G. Gilkes; William T. McClain

[57] ABSTRACT

A process for recovering and upgrading products from solid coal by contacting the coal with a dense-water-containing fluid at a temperature in the range of from about 600° F. to about 900° F. in the absence of externally supplied hydrogen or other reducing gas and in the presence of a sulfur-resistant catalyst.

22 Claims, 1 Drawing Figure

PROCESS FOR RECOVERING UPGRADED PRODUCTS FROM COAL

Maintenance of the water in the dense-water-containing phase at a relatively high density, whether at temperatures below or above the critical temperature of water, is essential to the method of this invention. The density of the water in the dense-water-containing phase must be at least 0.1 gram per milliliter.

BACKGROUND OF THE INVENTION

1. Field of the Invention

This invention involves a process for recovering liquids and gases from solid coal, and simultaneously for cracking and desulfurizing the recovered liquids and desulfurizing the remaining solid coal.

2. Description of the Prior Art

The potential reserves of liquid hydrocarbons and gases contained in subterranean carbonaceous deposits are known to be very substantial and form a large portion of the known energy reserves in the world. It is desirable from an economic standpoint to use coal to produce both liquid and gaseous fuels since coal is relatively inexpensive compared to petroleum crude oil and is quite abundant in contrast to our rapidly dwindling domestic supply of petroleum and natural gas sources. As a result of the increasing demand for light hydrocarbon fractions, there is much current interest in economical methods for recovering liquids and gases from coal on a commercial scale. Various methods for recovering liquids and gases from coal have been proposed, but the principal difficulty with these methods is that the apparatus used for recovering such products from coal is quite complicated and expensive, which renders the recovered products too expensive to compete with petroleum crudes recovered by more conventional methods.

Moreover, the value of liquids recovered from coal is diminished due to the presence of certain contaminants in the recovered liquids. The chief contaminants are sulfurous compounds which cause detrimental effects with respect to various catalysts utilized in a multitude of processes to which the recovered products may be subjected. These contaminants are also undesirable because of their disagreeable odor, corrosive characteristics, and combustion products.

Additionally, as a result of the increasing demand for light hydrocarbon fractions, there is much current interest in more efficient methods for converting the heavier liquid hydrocarbon fractions recovered from coal into lighter materials. The conventional methods of converting heavier hydrocarbon fractions into lighter materials, such as catalytic cracking, coking, thermal cracking and the like, always result in the production of more highly refractory materials.

It is known that such heavier hydrocarbon fractions and such refractory materials can be converted into ligher materials by hydrocracking. Hydrocracking processes are most commonly employed on liquefied coals or heavy residual or distillate oils for the production of substantial yields of low boiling saturated products and to some extent of intermediates which are utilizable as domestic fuels, and still heavier cuts which find uses as lubricants. These destructive hydrogenation processes or hydrocracking processes may be operated on a strictly thermal basis or in the presence of a catalyst.

However, application of the hydrocracking technique has in the past been fairly limited because of several interrelated problems. Conversion by the hydrocracking technique of heavy hydrocarbon fractions recovered from coal into more useful products is complicated by the presence of certain contaminants in such hydrocarbon fractions. Oils extracted from coal contain sulfurous compounds in exceedingly large quantities. The presence of sulfur-containing compounds in crude oils and various refined petroleum products and hydrocarbon fractions has long been considered undesirable.

For example, because of the disagreeable odor, corrosive characteristics and combustion products (particularly sulfur dioxide) of sulfur-containing compounds, sulfur removal has been of constant concern to the petroleum refiner. Further, the heavier hydrocarbons are largely subjected to hydrocarbon conversion processes in which the conversion catalysts are, as a rule, highly susceptible to poisoning by sulfur compounds. This has led in the past to the selection of low-sulfur hydrocarbon fractions whenever possible. With the necessity of utilizing heavy, high sulfur hydrocarbon fractions in the future, economical desulfurization processes are essential. This need is further emphasized by recent and proposed legislation which seeks to limit sulfur contents of industrial, domestic, and motor fuels.

Generally, sulfur appears in feedstocks in one of the following forms: mercaptans, hydrogen sulfides, sulfides, disulfides, and as part of complex ring compounds. The mercaptans and hydrogen sulfides are more reactive and are generally found in the lower boiling fractions, for example, gasoline, naphtha, kerosene, and light gas oil fractions. There are several well-known processes for sulfur removal from such lower boiling fractions. However, sulfur removal from higher boiling fractions has been a more difficult problem. Here, sulfur is present for the most part in less reactive forms as sulfides, disulfides, and as part of complex ring compounds of which thiophene is a prototype. Such sulfur compounds are not susceptible to the conventional chemical treatments found satisfactory for the removal of mercaptans and hydrogen sulfide and are particularly difficult to remove from heavy hydrocarbon materials.

However, in order to remove the sulfur and to convert the heavy residue into lighter more valuable products, the heavy hydrocarbon fraction is ordinarily subjected to a hydrocatalytic treatment. This is conventionally done by contacting the hydrocarbon fraction with hydrogen at an elevated temperature and pressure and in the presence of a catalyst. Unfortunately, unlike distillate stocks which are substantially free from asphaltenes and metals, the presence of asphaltenes and metal-containing compounds in heavy hydrocarbon fractions leads to a relatively rapid reduction in the activity of the catalyst to below a practical level. The presence of these materials in the charge stock results in the deposition of metal-containing coke on the catalyst particles, which prevents the charge from coming in contact with the catalyst and thereby, in effect, reduces the catalyst activity. Eventually, the on-stream period must be interrupted, and the catalyst must be regenerated or replaced with fresh catalyst.

Particularly objectionable is the presence of iron in the form of soluble organometallic compounds. Even when the concentration of iron porphyrin complexes and other iron organometallic complexes is relatively small, that is, on the order of parts per million, their presence causes serious difficulties in the refining and utilization of heavy hydrocarbon fractions. The presence of an appreciable quantity of the organometallic iron compounds in feedstocks undergoing cataltyic cracking causes rapid deterioration of the cracking catalysts and changes the selectivity of the cracking catalysts in the direction of more of the charge stock being converted to coke. Also, the presence of an appreciable quantity of the organo-iron compounds in feedstocks undergoing hydroconversion (such as hydrotreating or hydrocracking) causes harmful effects in the hydroconversion processes, such as deactivation of the hydroconversion catalyst and, in many instances, plugging or increasing of the pressure drop in fixed bed hydroconversion reactors due to the deposition of iron compounds in the interstices between catalyst particles in the fixed bed of catalyst.

Additionally, metallic contaminants such as nickel- and vanadium- containing compounds are harmful. When the hydrocarbon fractions are topped to remove the light fractions boiling above about 450°–650° F., the metals are concentrated in the residual bottoms. If the residuum is then further treated, such metals adversely affect catalysts. When the hydrocarbon fraction is used as a fuel, the metals also cause poor performance in industrial furnaces by corroding the metal surfaces of the furnace.

A promising technique for recovering liquids and gases from coal is a process called dense fluid extraction. Separation by dense fluid extraction at elevated temperatures is a relatively unexplored area. The basic principles of dense fluid extraction at elevated temperatures are outlined in the monograph "The Principles of Gas Extraction" by P. F. M. Paul and W. S. Wise, published by Mills and Boon Limited in London, 1971, of which Chapters 1 through 4 are specifically incorporated herein by reference. The dense fluid can be either a liquid or a dense gas having a liquid-like density.

Dense fluid extraction depends on the changes in the properties of a fluid — in particular, the density of the fluid — due to changes in the pressure. At temperatures below its critical temperature, the density of a fluid varies in step functional fashion with changes in the pressure. Such sharp transitions in the density are associated with vapor-liquid transitions. At temperatures above the critical temperature of a fluid, the density of the fluid increases almost linearly with pressure as required by the Ideal Gas Law, although deviations from linearity are noticeable at higher pressures. Such deviations are more marked as the temperature of the fluid is nearer, but still above, its critical temperature.

If a fluid is maintained at a temperature below its critical temperature and at its saturated vapor pressure, two phases will be in equilibrium with each other, liquid X of density C and vapor Y of density D. The liquid of density C will possess a certain solvent power. If the same fluid were then maintained at a particular temperature above its critical temperature and if it were compressed to density C, then the compresses fluid could be expected to possess a solvent power similar to that of liquid X of density C. A similar solvent power could be achieved at an even higher temperature by an even greater compression of the fluid to density C. However, because of the non-ideal behavior of the fluid near its critical temperature, a particular increase in pressure will be more effective in increasing the density of the fluid when the temperature is slightly above the critical temperature than when the temperature is much above the critical temperature of the fluid.

These simple considerations lead to the suggestion that at a given pressure and at a temperature above the critical temperature of a compressed fluid, the solvent power of the compressed fluid should be greater the lower the temperature; and that, at a given temperature above the critical temperature of the compressed fluid, the solvent power of the compressed fluid should be greater the higher the pressure.

Although such useful solvent effects have been found above the critical temperature of the fluid solvent, it is not essential that the solvent phase be maintained above its critical temperature. It is only essential that the fluid solvent be maintained at high enough pressures so that its density is high. Thus, liquid fluids and gaseous fluids which are maintained at high pressures and have liquid-like densities are useful solvents in dense fluid extractions at elevated temperatures.

The basis of separations by dense fluid extraction at elevated temperature is that a substrate is brought into contact with a dense, compressed fluid at an elevated temperature, material from the substrate is dissolved in the fluid phase, then the fluid phase containing this dissolved material is isolated, and finally the isolated fluid phase is decompressed to a point where the solvent power of the fluid is destroyed and where the dissolved material is separated as a solid or liquid.

Some general conclusions based on empirical correlations have been drawn regarding the conditions for achieving high solubility of substrates in dense, compressed fluids. For example, the solvent effect of a dense, compressed fluid depends on the physical properties of the fluid solvent and of the substrate. This suggests that fluids of different chemical nature but similar physical properties would behave similarly as solvents. An example is the discovery that the solvent power of compressed ethylene and carbon dioxide is similar.

In addition, it has been concluded that a more efficient dense fluid extraction should be obtained with a solvent whose critical temperature is nearer the extraction temperature than with a solvent whose critical temperature is farther from the extraction temperature. Further since the solvent power of the dense, compressed fluid should be greater the lower the temperature but since the vapor pressure of the material to be extracted should be greater the higher the temperature, the choice of extraction temperature should be a compromise between these opposing effects.

Various ways of making practical use of dense fluid extraction are possible following the analogy of conventional separation processes. For example, both the extraction stage and the decompression stage afford considerable scope for making separations of mixtures of materials. Mild conditions can be used to extract first the more volatile materials, and then more severe conditions can be used to extract the less volatile materials. The decompression stage can also be carried out in a single stage or in several stages so that the less volatile dissolved species separate first. The extent of extraction and of the recovery of product on decompression can be controlled by selecting an appropriate fluid solvent, by adjusting the temperature and pressure of the extraction or decompression, and by altering the ratio of substrate-to-fluid solvent which is charged to the extraction vessel.

In general, dense fluid extraction at elevated temperatures can be considered as an alternative, on the one hand, to distillation and, on the other hand, to extraction with liquid solvents at lower temperatures. A considerable advantage of dense fluid extraction over distillation is that it enables substrates of low volatility to be processed. Dense fluid extraction even offers an alternative to molecular distillation, but with such high concentrations in the dense fluid phase that a marked advantage in throughput should result. Dense fluid extraction would be of particular use where heat-labile substrates have to be processed since extraction into the dense fluid phase can be effected at temperatures well below those required by distillation.

A considerable advantage of dense fluid extraction at elevated temperatures over liquid extraction at lower temperatures is that the solvent power of the compressed fluid solvent can be continuously controlled by adjusting the pressure instead of the temperature. Having available a means of controlling solvent power by pressure changes gives a new approach and scope to solvent extraction processes.

Zhuze was apparently the first to apply dense fluid extraction to chemical engineering operations in a scheme for de-asphalting petroleum fractions using a propane-propylene mixture as gas, as reported in Vestnik Akad. Nauk S.S.S.R. 29 (11), 47–52 (1959); and in Petroleum (London) 23, 298–300 (1960).

Apart from Zhuze's work, there have been few detailed reports of attempts to apply dense fluid extraction techniques to substrates of commercial interest. British Pat. No. 1,057,911 (1964) describes the principles of gas extraction in general terms, emphasizes its use as a separation technique complementary to solvent extraction and distillation, and outlines multistage operation. British Pat. No. 1,111,422 (1965) refers to the use of gas extraction techniques for working up heavy petroleum fractions. A feature of particular interest is the separation of materials into residue and extract products, the latter being free from objectionable inorganic contaminants such as vanadium. The advantage is also mentioned in this patent of cooling the gas solvent at subcritical temperatures before recycling it. This converts it to the liquid form which requires less energy to pump it against the hydrostatic head in the reactor than would a gas. French Pat. Nos. 1,512,060 (1967) and 1,512,061 (1967) mention the use of gas extraction on petroleum fractions. In principle, these seem to follow the direction of the earlier Russian work.

Pevere, et al., U.S. Pat. No. 2,665,390 (1948) describes in general terms a process for dissolving coal in liquid solvents at high temperatures and then atomizing the solution into a carbonizer but does not mention the use of supercritical conditions. U.S. Defensive Publication 700,485 (filed Jan. 25, 1968) refers to the use of a gas extractant to recover, from a solution of coal in a liquid solvent a fraction suitable as a feedstock for hydrocracking to gasoline.

Seitzer, U.S. Pat. No. 3,642,607 (1972) discloses a process for dissolving bituminous coal by heating a mixture of bituminous coal, a hydrogen donor oil, carbon monoxide, water, and an alkali metal hydroxide or its precursor at a temperature of about 400°–450° C. and under a total pressure of at least about 4000 pounds per square inch gauge.

Seitzer, U.S. Pat. No. 3,687,838 (1972) discloses the same process as disclosed in U.S. Pat. No. 3,642,607 (1972) but employs an alkali metal or ammonium molybdate instead of an alkali metal hydroxide or its precursor.

Urban, U.S. Pat. No. 3,796,650 (1974) discloses a process for de-ashing and liquefying coal which comprises contacting comminuted coal with water, at least a portion of which is in the liquid phase, an externally supplied reducing gas and a compound selected from ammonia and carbonates and hydroxides of alkali metals, at liquefaction conditions, including a temperature of 200°–370° C. to provide a hydrocarbonaceous product.

There have also been numerous references to processes for cracking, desulfurizing, denitrifying, demetalating, and generally upgrading hydrocarbon fractions by processes involving water. For example, Gatsis, U.S. Pat. No. 3,453,206 (1969) discloses a multi-stage process for hydrorefining heavy hydrocarbon fractions for the purpose of eliminating and/or reducing the concentration of sulfurous, nitrogenous, organometallic, and asphaltenic contaminants therefrom. The nitrogenous and sulfurous contaminants are converted to ammonia and hydrogen sulfide. The stages comprise pretreating the hydrocarbon fraction in the absence of a catalyst, with a mixture of water and externally supplied hydrogen at a temperature above the critical temperature of water and a pressure of at least 1000 pounds per square inch gauge and then reacting the liquid product from the pretreatment stage with externally supplied hydrogen at hydrorefining conditions and in the presence of a catalytic composite. The catalytic composite comprises a metallic component composited with a refractory inorganic oxide carrier material of either synthetic or natural origin, which carrier material has a medium-to-high surface area and a well-developed pore structure. The metallic component can be vanadium, niobium, tantalum, molybdenum, tungsten, chromium, iron, cobalt, nickel, platinum, palladium, iridium, osmium, rhodium, ruthenium, and mixtures thereof.

Gatsis, U.S. Pat. No. 3,501,396 (1970) discloses a process for desulfurizing and denitrifying oil which comprises mixing the oil with water at a temperature above the critical temperature of water up to about 800° F. and at a pressure in the range of from about 1000 to about 2500 pounds per square inch gauge and reacting the resulting mixture with externally supplied hydrogen in contact with a catalytic composite. The catalytic composite can be characterized as a dual function catalyst comprising a metallic component such as iridium, osmium, rhodium, ruthenium and mixtures thereof and an acidic carrier component having cracking activity. An essential feature of this method is the catalyst being acidic in nature. Ammonia and hydrogen sulfide are produced in the conversion of nitrogenous and sulfurous compounds, respectively.

Pritchford et al., U.S. Pat. No. 3,586,621 (1971) discloses a method for converting heavy hydrocarbon oils, residual hydrocarbon fractions, and solid carbonaceous materials to more useful gaseous and liquid products by contacting the material to be converted with a nickel spinel catalyst promoted with a barium salt of an organic acid in the presence of steam. A temperature in the range of from 600° F. to about 1000° F. and a pressure in the range of from 200 to 3000 pounds per square inch gauge are employed.

Pritchford, U.S. Pat. No. 3,676,331 (1972) discloses a method for upgrading hydrocarbons and thereby producing materials of low molecular weight and of reduced sulfur content and carbon residue by introducing water and a catalyst system containing at least two components into the hydrocarbon fraction. The water can be the natural water content of the hydrocarbon fraction or can be added to the hydrocarbon fraction from an external source. The water-to-hydrocarbon fraction volume ratio is preferably in the range from about 0.1 to about 5. At least the first of the components of the catalyst system promotes the generation of hydrogen by reaction of water in the water gas shift reaction and at least the second of the components of the catalyst system promotes reaction between the hydrogen generated and the constituents of the hydrocarbon fraction. Suitable materials for use as the first component of the catalyst system are the carboxylic acid salts of barium, calcium, strontium, and magnesium. Suitable materials for use as the second component of the catalyst system are the carboxylic acid salts of nickel, cobalt, and iron. The process is carried out at a reaction temperature in the range of from about 750° F. to about 850° F. and at a pressure of from about 300 to about 4000 pounds per square inch gauge in order to maintain a principal portion of the crude oil in the liquid state.

Wilson et al., U.S. Pat. No. 3,733,259 (1973) discloses a process for removing metals, asphaltenes, and sulfur from a heavy hydrocarbon oil. The process comprises dispersing the oil with water, maintaining this dispersion at a temperature between 750° F. and 850° F. and at a pressure between atmospheric and 100 pounds per square inch gauge, cooling the dispersion after at least one-half hour to form a stable water-asphaltene emulsion, separating the emulsion from the treated oil, adding hydrogen, and contacting the resulting treated oil with a hydrogenation catalyst at a temperature between 500° F. and 900° F. and at a pressure between about 300 and 3000 pounds per square inch gauge.

It has also been announced that the semi-governmental Japan Atomic Energy Research Institute, working with the Chisso Engineering Corporation, has developed what is called a "simple, low-cost, hot-water, oil desulfurization process" said to have "sufficient commerical applicability to compete with the hydrogenation process." The process itself consists of passing oil through a pressurized boiling water tank in which water is heated up to approximately 250° C., under a pressure of about 100 atmospheres. Sulfides in oil are then separated when the water temperature is reduced to less than 100° C.

Thus far, no one has disclosed the method of this invention for recovering liquids and gases from coal, cracking and desulfurizing the recovered liquids, and desulfurizing the remaining solid coal, which permits operation at lower than conventinal temperatures, without an external source of hydrogen or other reducing gas, and without preparation or pretreatment, such as desalting or demetalation, prior to upgrading the recovered liquids.

SUMMARY OF THE INVENTION

This invention is a process for recovering liquids and gases from bituminous or sub-bituminous coal solids and simultaneously for cracking and desulfurizing the recovered liquids and desulfurizing the remaining solid coal, which comprises contacting the coal solids with a water-containing fluid at a temperature in the range of from about 600° F. to about 900° F. in the absence of externally supplied hydrogen or other reducing gas such as carbon monoxide and in the presence of an externally supplied, sulfur-resistant catalyst selected from the group consisting of at least one basic metal carbonate, basic metal hydroxide, transition metal oxide, oxide-forming transition metal salt, and combinations thereof. The density of water in the water-containing fluid is at least 0.10 gram per milliliter, and sufficient water is present to serve as an effective solvent for the recovered liquids and gases.

The water-containing fluid can contain an organic material which is preferably selected from the group consisting of biphenyl, pyridine, a highly saturated oil, an aromatic oil, a partly hydrogenated aromatic oil, and a mono- or polyhydric compound, which is more preferably selected from the group consisting of biphenyl, pyridine, a highly saturated oil, and a mono- or polyhydric compound, and which is most preferably a highly saturated oil.

The density of water in the water-containing fluid is preferably at least 0.15 gram per milliliter and most preferably at least 0.2 gram per milliliter. The temperature is preferably at least 705° F., the critical temperature of water. The coal solids and water-containing fluid are contacted preferably for a period of time in the range of from about 1 minute to about 6 hours, more preferably in the range of from about 5 minutes to about 3 hours and most preferably in the range of from about 10 minutes to about 1 hour. The wight ratio of the coal solids-to-water in the water containing fluid is preferably in the range of from about 3:2 to about 1:10 and more preferably in the range of from about 1:2 to about 1:3. The water-containing fluid is preferably substantially water and more preferably water. The coal solids have preferably a maximum particle size of one-half inch diameter, more preferably a maximum particle size of one-quarter inch diameter and most preferably a maximum particle size of 8 mesh.

The transition metal in the oxide and salt in the catalyst is selected preferably from the group consisting of a transition metal of Group IVB, VB, VIB, and VIIB of the Periodic Chart, more preferably from the group consiting of vanadium, chromium, manganese, titanium, molybdenum, zirconium, niobium, tantalum, rhenium, and tungsten, and most preferably from the group consisting of chromium, manganese, titanium, tantalum, and tungsten. The metal in the basic metal carbonate and hydroxide is selected preferably from the group consisting of alkali and alkaline earth metals and more preferably from the group consisting of sodium and potassium. The catalyst is present in a catalytically effective amount which is equivalent to a concentration level in the water in the water-containing fluid preferably in the range of from about 0.01 to about 3.0 weight percent and more preferably in the range of from about 0.10 to about 0.50 weight percent.

DETAILED DESCRIPTION

Figure 1:
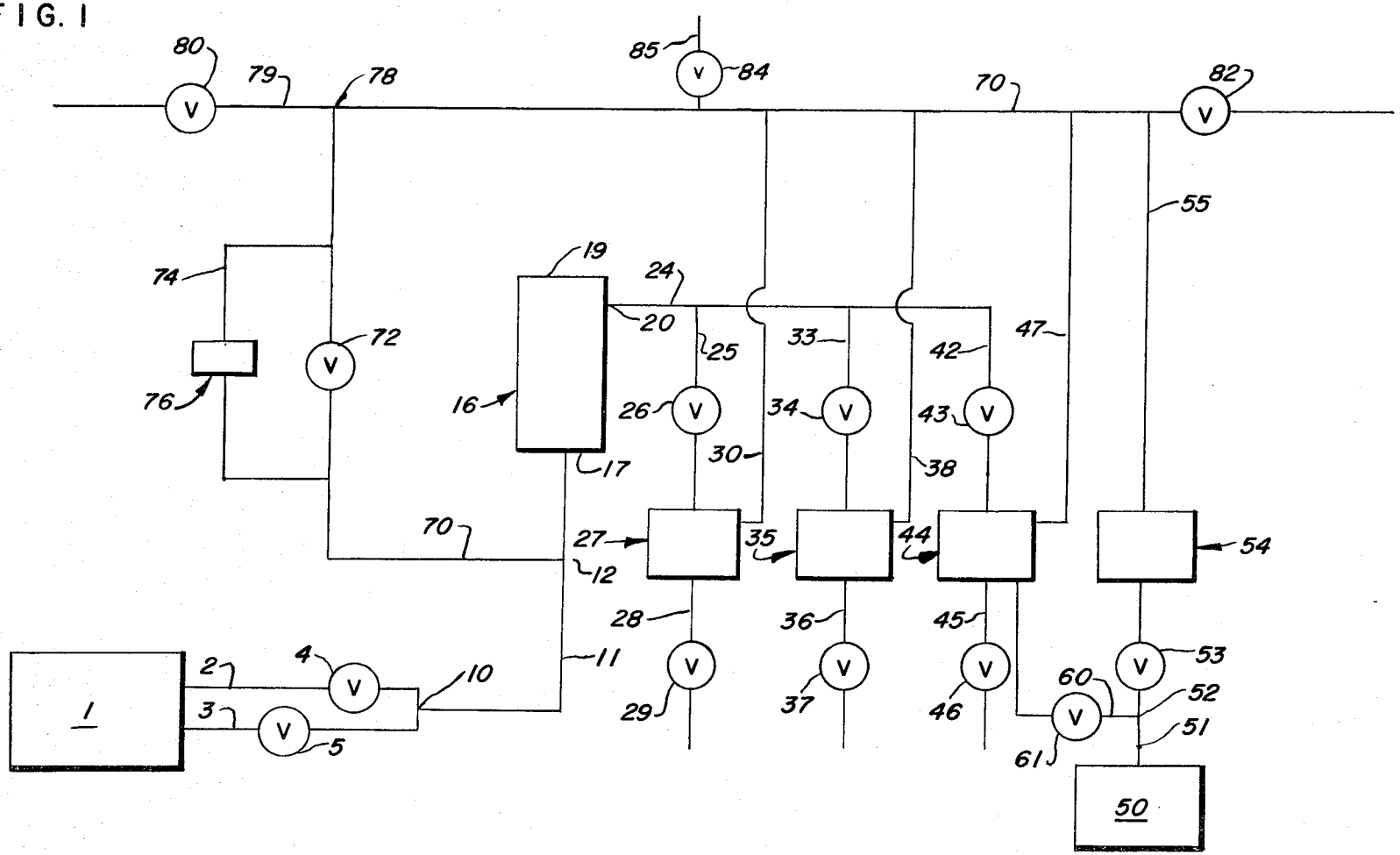
FIG. 1 is a schematic diagram of the flow system used for semicontinuously processing a hydrocarbon fraction.

It has been found that liquids and gases can be recovered from coal solids, that the recovered liquids can be upgraded, cracked and desulfurized, and that the remaining solid coal can be desulfurized by contacting the coal solids with a dense-water-containing phase, either gas or liquid, at a reaction temperature in the range of from about 600° F. to about 900° F. in the absence of externally supplied hydrogen or other reducing gas such as carbon monoxide and in the presence of an externally supplied, sulfur-resistant transition metal catalyst.

We have found that, in order to effect the recovery of liquids and gases from coal, in order to effect the chemical conversion of the recovered hydrocarbons into lighter, more useful hydrocarbon fractions, and in order to desulfurize the remaining solid coal by the method of this invention — which involves processes characteristically occurring in solution rather than typical pyrolytic processes — the water in the dense-water-containing fluid phase must have a high solvent power and liquid-like densities — for example, at least 0.1 gram per milliliter — rather than vapor-like densities. Maintenance of the water in the dense-water-containing phase at a relatively high density, whether at temperatures below or above the critical temperature of water, is essential to the method of the invention. The density of the water in the dense-water-containing phase must be at least 0.1 gram per milliliter.

The high solvent power of dense fluids is discussed in the monograph "The Principles of Gas Extraction" by P. F. M. Paul and W. S. Wise, published by Mills and Boon Limited in London, 1971. For example, the difference in the solvent power of steam and of dense gaseous water maintained at a temperature in the region of the critical temperature of water and at an elevated pressure is substantial. Even normally unsoluble inorganic materials, such as silica and alumina, commence to dissolve appreciably in "supercritical water" — that is, water maintained at a temperature above the critical temperature of water — so long as a high water density is maintained.

Enough water must be employed so that there is sufficient water in the dense-water-containing phase to serve as an effective solvent for the recovered liquids and gases. The water in the dense-water-containing phase can be in the form either of liquid water or of dense gaseous water. The vapor pressure of water in the dense-water-containing phase must be maintained at a sufficiently high level so that the density of water in the dense-water-containing phase is at least 0.1 gram per milliliter.

We have found that, with the limitations imposed by the size of the reaction vessels we employed in this work, a weight ratio of the coal solids-to-water in the dense-water-containing phase in the range of from about 3:2 to about 1:10 is preferable, and a weight ratio in the range of from about 1:1 to about 1:3 is more preferable.

A particularly useful water-containing fluid contains water in combination with an organic compound such as biphenyl, pyridine, a highly saturated oil, an aromatic oil, a partly hydrogenated aromatic oil, or a mono- or polyhyric compound such as methyl alcohol. The use of such combinations extends the limits of solubility and rates of dissolution so that cracking and desulfurization can occur even more readily. Furthermore, the component other than water in the dense-water-containing phase can serve as a source of hydrogen, for example, by reaction with water.

The catalyst employed in the method of this invention is effective when added in an amount equivalent to a concentration in the water of the water-containing fluid in the range of from about 0.01 to about 3.0 weight percent and perferably in the range of from about 0.10 to about 0.50 weight percent.

The catalyst may be added as a solid and slurried in the reaction mixture or as a water-soluble salt, for example manganese chloride or potassium permanganate, which produces the corresponding oxide under the conditions employed in the method of this invention. Alternately, the catalyst can be deposited on a support and used as such in a fixed-bed flow configuration or slurried in the water-containing fluid.

This process can be performed either as a batch process or as a continuous or semi-continuous flow process. Contact times between the coal solids and the dense-water-containing phase — that is, residence time in a batch process or inverse solvent space velocity in a flow process — of from the order of minutes up to about 6 hours are satisfactory for effective cracking and desulfurization of the recovered products.

In the method of this invention, the water-containing fluid and the coal solids are contacted by making a slurry of the coal solids in the water-containing fluid.

When the method of this invention is performed above ground with mined coal, the desired products can be recovered more rapidly if the mined solids are ground to a particle size preferably of ½-inch diameter or smaller. Alternately, the method of this invention could also be performed in situ in subterranean deposits by pumping the water-containing fluid into the deposit and withdrawing the recovered products for separation or further processing.

EXAMPLES 1–17

Examples 1–17 involve batch processing of coal feeds under a variety of conditions and illustrate that liquids and gases are recovered, that the recovered liquids are cracked and desulfurized, and that the remaining solid coal is desulfurized in the method of this invention. Unless otherwise specified, the following procedure was used in each case. The coal feed, water-containing fluid, and components of the catalyst system, if used, were loaded at ambient temperature into a 300-milliliter Hastelloy alloy C Magne-Drive batch autoclave in which the reaction mixture was to be mixed. The components of the catalyst system were added as solutes in the water-containing fluid or as solids in slurries in the water-containing fluid. Unless otherwise specified, sufficient water was added in each Example so that, at the reaction temperature and pressure and in the reaction volume used, the density of the water was at least 0.1 gram per milliliter.

The autoclave was flushed with inert argon gas and was then closed. Such inert gas was also added to raise the pressure of the reaction system. The contribution of argon to the total pressure at ambient temperature is called the argon pressure.

The temperature of the reaction system was then raised to the desired level and the dense-water-containing fluid phase was formed. Approximately 28 minutes were required to heat the autoclave from ambient temperature to 660° F. Approximately 6 minutes were required to raise the temperature from 660° F. to 700° F. Approximately another 6 minutes were required to raise the temperature from 700° F. to 750° F. When the desired final temperature was reached, the temperature was held constant for the desired period of time. This final constant temperature and the period of time at this temperature are defined as the reaction temperature and reaction time, respectively. During the reaction time, the pressure of the reaction system increased as the reaction proceeded. The pressure at the start of the reaction time is defined as the reaction pressure.

After the desired reaction time at the desired reaction temperature and pressure, the dense-water-containing fluid phase was de-pressurized by flash-distilling from the reaction vessel, removing the argon, gas products, water, and "oil," and leaving the "bitumen," solid residue, and catalyst, if present, in the reaction vessel. The "oil" was the liquid hydrocarbon fraction boiling at or below the reaction temperature and the "bitumen" was the liquid hydrocarbon fraction boiling above the reaction temperature. The solid residue was remaining solid coal.

The argon, gas products, water, and oil were trapped in a pressure vessel cooled by liquid nitrogen. The argon and gas products were removed by warming the pressure vessel to room temperature, and then the gas products were analyzed by mass spectroscopy, gas chromatography, and infra-red. The water and oil were then purged from the pressure vessel by means of compressed gas and occasionally also by heating the vessel. Then the water and oil were separated by decantation. The oil was analyzed for its sulfur content using X-ray fluoresence.

The bitumen, solid residue, and catalyst, if present, were washed from the reaction vessel with chloroform, and the bitumen dissolved in this solvent. The solid residue and catalyst, if present, were then separated from the solution containing the bitumen by filtration. The bitumen and solids were analyzed for their sulfur contents using the same method as in the analysis of the oil.

The weights of the various components or fractions added and recovered were determined either directly or indirectly by difference at various stages during the procedure.

Three samples of coal were used in this work. The samples were obtained in the form of lumps, which were then ground and sieved to obtain fractions of various particle sizes. The particle size and moisture and sulfur contents of each sample used are presented in Table 1. Samples A and B were obtained from Commonwealth Edison Company, while sample C was an Illinois number 6 seam coal obtained from Hydrocarbon Research Incorporated. Sample A was a sub-bituminous coal, while samples B and C were highly volatile bituminous coals. These samples were stored under a blanket of argon until used.

Examples 1–17 involve batch recovery of liquids and gases from the coal samples shown in Table 1 using the method described above.

TABLE 1

| Coal Sample | Particle Size[1] | Moisture Content[2] | Sulfur Content[3] |
|---|---|---|---|
| A | 10–40 | 22.2 | 0.74 |
| B | 10–40 | 9.7 | 4.5 |
| C[4] | > 80 | 2.7 | 4.9 |

[1]mesh size.
[2]weight percent.
[3]weight percent, on a moisture-free basis.
[4]pre-dried.

These runs were performed in a 300-milliliter Hastelloy alloy C Magne-Drive autoclave. The experimental conditions and the results determined in these Examples are presented in Tables 2 and 3, respectively.

In these Examples, the liquid hydrocarbon products were classified either as oils or as bitumens depending on whether or not such liquid products could be flashed from the autoclave upon depressurization of the autoclave at the run temperature employed. Oils were those liquid products which flashed over at the run temperature, while bitumens were those liquid products which remained in the autoclave.

The weight balance shown in Table 3 was obtained by dividing the sum of the weights of the gas, liquid, and solid products recovered and of the weights of the water, argon, and catalyst, if used, recovered by the sum of the weights of the coal, water, co-solvent, argon, and catalyst, if used, initially charged to the autoclave. The product composition, reported as a weight percent on a moisture-free basis, was calculated by dividing the weight of the particular product in grams by the difference between the weight of the coal feed in grams and its moisture content in grams. The percent of coal conversion is 100 minus the weight percent of solid recovered.

The results shown in Table 3 illustrate that substantial conversion of coal solids occurred with both bituminous and sub-bituminous coal using the method of this invention. There was also substantial desulfurization in each case where the sulfur content of the products was determined. Addition of a catalyst in the method of this invention in Examples 16 and 17 resulted in an increase in the production of the oil fraction relative to the gas and bitumen fractions.

The results of Examples 9, 10, and 12 indicate that the organic co-solvent made no contribution to the amount of solid product recovered. Therefore, the amount of solid remaining after processing under the conditions of the method of this invention is a good measure of the extent of conversion of solid coal to gas and liquid products, even in the presence of a co-solvent.

TABLE 2

| Example | Coal Sample[1] | Reaction Temperature[2] | Reaction Time[3] | Reaction Pressure[4] | Argon Pressure[4] | Amount of Water Added[5] | Coal-to Water weight Ratio | Amount of co-solvent Added[5] | Amount of NaOH Added[5] |
|---|---|---|---|---|---|---|---|---|---|
| 1 | A | 752 | 3 | 4200 | 350 | 90 | .56 | — | — |
| 2 | B | 752 | 3 | 4250 | 250 | 90 | .56 | — | — |
| 3 | C | 689 | 2 | 3700 | 450 | 150 | .33 | — | — |
| 4 | C | 752 | 2 | 4450 | 400 | 90 | .56 | — | — |
| 5 | C | 750 | 2 | 4300 | 250 | 85 | .59 | 5[6] | — |
| 6 | C | 752 | 2 | 4300 | 250 | 100 | .20 | — | — |
| 7 | C | 752 | 2 | — | 250 | 90 | .22 | 20[7] | — |
| 8 | C | 752 | 2 | 4550 | 250 | 90 | .22 | 40[8] | — |
| 9 | — | 752 | 2 | 4550 | 250 | 90 | 0 | 40[8] | — |
| 10 | — | 752 | 2 | 4300 | 250 | 90 | 0 | 40[9] | — |
| 11 | C | 752 | 2 | 4300 | 250 | 90 | .22 | 20[9] | — |
| 12 | — | 752 | 2 | 4300 | 250 | 90 | 0 | 40[9] | — |
| 13 | — | 752 | 2 | 4150 | 250 | 90 | 0 | 30[10] | — |
| 14 | C | 752 | 2 | 4200 | 250 | 90 | .22 | 20[10] | — |

TABLE 2-continued

| Example | Coal Sample[1] | Reaction Temperature[2] | Reaction Time[3] | Reaction Pressure[4] | Argon Pressure[4] | Amount of Water Added[5] | Coal-to Water weight Ratio | Amount of co-solvent Added[5] | Amount of NaOH Added[5] |
|---|---|---|---|---|---|---|---|---|---|
| 15 | B | 752 | 2 | 4300 | 250 | 90 | .22 | 20[10] | — |
| 16 | A | 752 | 2 | 4200 | 250 | 90 | .56 | — | .5 |
| 17 | C | 752 | 2 | 4200 | 250 | 90 | .56 | — | .5 |

[1]The samples corresponding to the letters are identified in Table 1.
[2]° F.
[3]hours.
[4]pounds per square inch gauge.
[5]grams.
[6]Methyl alcohol is the co-solvent.
[7]Biphenyl is the co-solvent.
[8]The co-solvent is a highly saturated, solvent extracted base oil, containing no sulfur, 4.5 weight percent of aromatic carbon atoms, and 33.7 weight percent of naphthenic carbon atoms, and having an API gravity of 32.1° and a density of 0.863 gram per milliliter.
[9]The co-solvent is a highly saturated, hydrofinished white oil containing no sulfur, no aromatic carbon atoms, and 44.3 weight percent of naphthenic carbon atoms, and having an API gravity of 28.2° and a density of 0.833 gram per milliliter.
[10]The co-solvent is decanted oil, an aromatic waste product removed from catalytic cracker cyclones, containing 3.5 weight percent of sulfur and 51 weight percent of aromatic carbon atoms and having an API gravity of 1.8°.

TABLE 3

| Example | Product Composition[1] | | | | Product Composition[2] | | | | Weight Percent of Coal Conversion | Sulfur Content[3] | | | Weight Balance |
|---|---|---|---|---|---|---|---|---|---|---|---|---|---|
| | Gas | Oil | Bitumen | Solid[4] | Gas | Oil | Bitumen | Solid[4] | | Oil | Bitumen | Solid | |
| 1 | 5.2 | 4.3 | 3.6 | 26.3 | 13 | 11 | 9.3 | 68 | 32 | — | — | — | 103.4 |
| 2 | 3.2 | 4.5 | 2.6 | 34.3 | 7.1 | 10 | 5.8 | 76 | 24 | — | — | 24 | 101.2 |
| 3 | 7.4 | 1.3 | 7.7 | 36.2 | 15 | 2.7 | 16 | 74 | 26 | — | — | — | — |
| 4 | 3.6 | 6.0 | 1.7 | 34.9 | 7.4 | 12 | 3.5 | 72 | 28 | — | — | 2.8 | 105.1 |
| 5 | 6.9 | 5.4 | 0.6 | 37.0 | — | — | — | 76 | 24 | — | — | — | 100.9 |
| 6 | 1.1 | 5.6 | 0.6 | 14.0 | 5.7 | 29 | 3.1 | 72 | 28 | 3.1 | — | 2.2 | 101.5 |
| 7 | — | 19.1 | 1.1 | 13.6 | — | — | — | 70 | 30 | — | — | — | — |
| 8 | 13.4 | 33.8 | 4.4 | 11.9 | — | — | — | 61 | 39 | — | — | 2.2 | 98.9 |
| 9 | 1.4 | 36.8 | 2.4 | 0 | — | — | — | 0 | 0 | — | — | — | 102.4 |
| 10 | 3.3 | 13.2 | 20.4 | 0 | — | — | — | 0 | 0 | — | — | — | 101.4 |
| 11 | 3.3 | 18.9 | 3.9 | 12.1 | — | — | — | 62 | 38 | — | — | 2.2 | 97.9 |
| 12 | 0.9 | 18.8 | 12.4 | 0 | — | — | — | 0 | 0 | — | — | — | 102.0 |
| 13 | 0.6 | 22 | 9 | 0.9 | — | — | — | 0 | 0 | — | — | — | 106.0 |
| 14 | 1.0 | 18.8 | 4.8 | 15.2 | — | — | — | 78 | 22 | — | — | — | 99.5 |
| 15 | 2.3 | 41.6 | 4.0 | 15.6 | — | — | — | 86 | 14 | — | — | — | 101.0 |
| 16 | 4.0 | 4.8 | 1.0 | 26.1 | 10 | 12 | 2.6 | 67 | 33 | 0.3 | 0.6 | 0.45 | 100.3 |
| 17 | 3.0 | 6.5 | 2.4 | 36.0 | 6 | 13 | 5 | 72 | 28 | 1.8 | 2.3 | 2.7 | 99.9 |

[1]grams.
[2]weight percent of the coal feed, on a moisture-free basis.
[3]weight percent of the particular product fraction, on a moisture-free basis.
[4]including catalyst, if present.

Generally, the extent of coal conversion increased markedly when a saturated, non-aromatic oil or biphenyl was the co-solvent. No attempt was made to distinguish between the contributions of the coal feed and of the co-solvent to the yields of gas and liquid products, when a co-solvent was used.

EXAMPLES 18–31

Examples 18–31 involve batch processing of different types of hydrocarbon feedstocks under a variety of conditions and illustrate that the method of this invention effectively cracks, desulfurizes, and demetalates hydrocarbons and therefore that the hydrocarbons recovered from coal are also cracked, desulfurized and demetalated in the method of this invention. Unless otherwise specified, the following procedure was used in each case. The hydrocarbon feed, water, and catalyst, if any, were loaded at ambient temperature into a 300-milliliter Hastelloy alloy C Magne-Drive autoclave in which the reaction mixture was to be mixed. The components of the catalyst system were added as solutes in the water or as solids in slurries in the water. Unless otherwise specified, sufficient water was added in each Example so that, at the reaction temperature and pressure and in the reaction volume used, the density of the water was at least 0.1 gram per milliliter.

The autoclave was flushed with inert argon gas and was then closed. Such inert gas was also added to raise the pressure of the reaction system. The contribution of argon to the total pressure at ambient temperature is called the argon pressure.

The temperature of the reaction system was then raised to the desired level and the dense-water-containing fluid phase was formed. Approximately 28 minutes were required to heat the autoclave from ambient temperature to 660° F. approximately 6 minutes were required to raise the temperature from 660° F. to 700° F. Approximately another 6 minutes were required to raise the temperature from 700° F. to 750° F. When the desired final temperature was reached, the temperature was held constant for the desired period of time. This final constant temperature and the period of time at this temperature are defined as the reaction temperature and reaction time, respectively. During the reaction time, the pressure of the reaction system increased as the reaction proceeded. The pressure at the start of the reaction time is defined as the reaction pressure.

After the desired reaction time at the desired reaction temperature and pressure, the dense-water-containing fluid phase was de-pressurized by flash-distilling from the reaction vessel, removing the argon, gas products, water, and "light" ends, and leaving the "heavy" ends and other solids, including the catalyst, if present, in the reaction vessel. The "light" ends were the hydrocarbon fraction boiling at or below the reaction temperature and the "heavy" ends were the hydrocarbon fraction boiling above the reaction temperature.

The argon, gas products, water, and light ends were trapped in a pressure vessel cooled by liquid nitrogen. The argon and gas products were removed by warming the pressure vessel to room temperature and then the gas products were analyzed by mass spectroscopy, gas chromatography, and infra-red. The water and light ends were then purged from the pressure vessel by means of compressed gas and occasionally also by heating the vessel. Then the water and light ends were separated by decantation. Alternately, this separation was postponed until a later stage in the procedure. Gas chromatograms were run on the light ends.

The heavy ends and solids, including the catalyst, if present, were washed from the reaction vessel with chloroform, and the heavy ends dissolved in this solvent. The solids were then separated from the solution containing the heavy ends by filtration.

After separating the chloroform from the heavy ends by distillation, the light ends and heavy ends were combined. If the water had not already been separated from the light ends, then it was separated from the combined light and heavy ends by centrifugation and decantation. The combined light and heavy ends were analyzed for their nickel, vanadium, and sulfur content, carbon-hydrogen atom ratio (C/H), and API gravity. The water and the solids were analyzed for nickel, vanadium, and sulfur. X-ray fluoresence was used to determine nickel, vanadium, and sulfur.

Examples 18–22 involve straight tar sands oil, and Examples 23–26 involve topped tar sands oil. Topped tar sands oil is the straight tar sands oil used in Examples 18–22 but from which approximately 25 weight percent of light material has been removed. Examples 27–30 involve C atmospheric residual oil. Example 31 involves C vacuum residual oil. The compositions of the hydrocarbon feeds employed are shown in Table 4. The experimental conditions used and the results of analyses of the products obtained in these Examples are shown in Tables 5 and 6, respectivelly. A 300-milliliter Hastelloy alloy C Magne-Drive autoclave was employed as the reaction vessel in these Examples.

Comparison of the results shown in Table 6 indicates that desulfurization and demetalation of the hydrocarbon feed occurred and that the hydrocarbon feed was cracked, producing gases, light ends, heavy ends, and solid residue, even when no catalyst was added from an external source. In such case, the extent of removal of sulfur and metals increased when the reaction time was increased from 1 to 3 hours. Beyond that time, the extent of desulfurization decreased with increasing reaction time. Addition of a catalyst susbstantially increased the extent of desulfurization and demetalation. Further, when the water density was less than 0.1 gram per milliliter — for example, when the weight ratio of hydrocarbon fraction-to-water in the water-containing fluid was 4:1 or 5:4 — there was an adverse shift in the distribution of hydrocarbon products and a lesser extent of desulfurization.

TABLE 4

| Components | Tar Sands Oils | | Atmospheric Residual Oils | | | C Vacuum |
|---|---|---|---|---|---|---|
| | Straight | Topped | Khafji | C | Cyrus | Residual Oil |
| Sulfur[1] | 4.56 | 5.17 | 3.89 | 3.44 | 5.45 | 4.64 |
| Vanadium[2] | 182 | 275 | 93 | 25 | 175 | 54 |
| Nickel[2] | 74 | 104 | 31 | 16 | 59 | 34 |
| Carbon[1] | 83.72 | 82.39 | 84.47 | 85.04 | 84.25 | 84.88 |
| Hydrogen[1] | 10.56 | 9.99 | 10.99 | 11.08 | 10.20 | 10.08 |
| H/C atom ratio | 1.514 | 1.455 | 1.56 | 1.56 | 1.45 | 1.43 |
| API gravity[3] | 12.2 | 7.1 | 14.8 | 15.4 | 9.8 | 5.4 |
| Liquid fraction,[1] boiling up to 650° F. | 29.4 | 9.7 | 10.6 | 12.0 | 6.9 | 9.1 |

[1]weight percent.
[2]parts per million.
[3]° API.

TABLE 5

| Example | Reaction Time[1] | Reaction Temperature[2] | Reaction Pressure[3] | Argon Pressure[3] | Catalyst | Amount of Catalyst Added[4] | Amount of Water[4] | Hydrocarbon-to-Water Weight Ratio |
|---|---|---|---|---|---|---|---|---|
| 18 | 6 | 752 | 4400 | 450 | — | — | 90 | 1:3 |
| 19 | 3 | 752 | 4350 | 400 | — | — | 90 | 1:3 |
| 20 | 1 | 752 | 4350 | 400 | — | — | 90 | 1:3 |
| 21 | 2 | 752 | 4200 | 400 | NaOH | 0.04 | 80 | 1:3 |
| 22 | 1 | 752 | 4300 | 400 | $MnO_2$ | 0.30 | 91 | 1:3 |
| 23 | 1 | 752 | 4300 | 400 | — | — | 90 | 1:3 |
| 24 | 3 | 752 | 4300 | 400 | — | — | 90 | 1:3 |
| 25 | 2 | 752 | 4350 | 400 | NaOH | 0.04 | 80 | 1:3 |
| 26 | 1 | 752 | 4250 | 400 | $MnO_2$ | 0.30 | 90 | 1:3 |
| 27 | 1 | 752 | 4450 | 400 | KOH | 0.5 | 90 | 1:3 |
| 28 | 1 | 752 | 4550 | 400 | KOH | 1 | 90 | 1:3 |
| 29 | 6 | 710 | 2600 | 450 | — | — | 30 | 4:1 |
| 30 | 6 | 710 | 3600 | 450 | — | — | 90 | 1:3 |
| 31 | 1 | 752 | 4150 | 400 | KOH | 1 | 90 | 1:3 |

[1]hours.
[2]° F.
[3]pounds per square inch gauge.
[4]grams.

Table 6

| Example | Product Composition[1] Gas | Light Ends | Heavy Ends | Solids | Percent Removal of[2] Sulfur | Nickel | Vanadium | H/C Atom Ratio | API Gravity[3] | Weight Balance[4] |
|---|---|---|---|---|---|---|---|---|---|---|
| 18 | 3.7 | 84.2 | 5.7 | 6.4 | 56 | — | — | — | — | 97.2 |
| 19 | 11.2 | 75.2 | 8.6 | 5.0 | 63 | 95 | 74 | 1.451 | 20.5 | 100.2 |
| 20 | 1.3 | 70.6 | 27.1 | 1.0 | 36 | 69 | 77 | 1.362 | 20.5 | 99.4 |
| 21 | 2.7 | 72.1 | 23.0 | 2.2 | 74 | 85 | 82 | — | — | 99.7 |
| 22 | 7.7 | 68.6 | 22.4 | 1.3 | 80 | 80 | 96 | — | — | 99.8 |
| 23 | 1.0 | 62.9 | 39.4 | 0.1 | 39 | 42 | 75 | — | — | 99.9 |
| 24 | 5.9 | 67.2 | 20.0 | 6.9 | 49 | 77 | 96 | 1.418 | 12.5 | 99.7 |
| 25 | 5.0 | 59.9 | 32.2 | 2.9 | 37 | 91 | 92 | — | — | 100.0 |
| 26 | 5.7 | 59.8 | 33.2 | 1.3 | 80 | 86 | 93 | — | — | 100.3 |
| 27 | 1.3 | 54.3 | 36.9 | 7.5 | 79 | — | 92 | — | — | 100.6 |
| 28 | 2.0 | 51.7 | 39.7 | 6.7 | 82 | — | 90 | — | — | 101.1 |
| 29 | 2.5 | 35.3 | 62.1 | 0.7 | 30 | — | — | — | — | 98.4 |
| 30 | 4.7 | 53.0 | 38.0 | 1.3 | 32 | — | — | — | — | 100.7 |
| 31 | 1.3 | 29.7 | 60.8 | 8.2 | 90 | 96 | 24 | — | — | 100.1 |

[1]weight percent of hydrocarbon feed.
[2]These values were obtained from analyses of the combined light and heavy ends.
[3]° API.
[4]total weight percent of hydrocarbon and water feeds and catalyst recovered as product and water.

However, with a solid substrate like coal, a weight ratio of solid-to-water in the water-containing fluid as high as 3:2 is sufficient to produce a water density of at least 0.1 gram per milliliter because the volume of the solids reduces the free volume of the autoclave.

The total weight percent of gases and compositions of the gas products obtained in several of the Examples are indicated in Table 7. In all cases, the main gaseous component was argon which was used in the pressurization of the reactor and which is not reported in Table 7. Generally, increasing the reaction time resulted in increased yields of gaseous products.

Successive exposure of the catalysts of this invention to hydrocarbons containing sulfur contaminants did not cause a decrease in the catalytic efficiency of the catalysts.

EXAMPLES 32–41

Examples 32–41 involve semi-continuous flow processing at 752° F. of straight tar sands oil under a variety of conditions. The flow system used in these Examples is shown in FIG. 1. To start a run, ⅛-inch diameter, inert, spherical alundum balls or irregularly shaped, catalytic titanium oxide chips having 2 weight percent of ruthenium deposited thereon were loaded into a 21.5-inch long, 1-inch outside diameter, and 0.25-inch inside diameter, vertical Hastelloy alloy C pipe reactor 16. The alundum balls served merely to provide an inert surface on which metals to be removed from the hydrocarbon feed could deposit. Top 19 was then closed, and a furnace (not shown) was placed around the length of pipe reactor 16. Pipe reactor 16 had total effective heated volume of approximately 12 milliliters, and the packing material had a total volume of approximately 6 milliliters, leaving approximately a 6-milliliter free effective heated space in pipe reactor 16.

All valves, except 53 and 61, were opened, and the flow system was flushed with argon or nitrogen. Then, with valves 4, 5, 29, 37, 46, 53, 61, and 84 closed and with Annin valve 82 set to release gas from the

TABLE 7

| Example | Reaction Time[1] | Composition of the Gas Products[2] Hydrogen | Carbon Dioxide | Methane | Total Weight Percent of Gas |
|---|---|---|---|---|---|
| 19 | 3 | 3.3 | 5.2 | 6.9 | 11.2 |
| 20 | 1 | 2.8 | 3.1 | 3.4 | 1.3 |
| 23 | 1 | 1.0 | 3.8 | 8.4 | 1.0 |

TABLE 7-continued

| Example | Reaction Time[1] | Composition of the Gas Products[2] Hydrogen | Carbon Dioxide | Methane | Total Weight Percent of Gas |
|---|---|---|---|---|---|
| 24 | 3 | 3.0 | 5.6 | 7.5 | 5.9 |

[1]hours.
[2]mole percent of gas.

flow system when the desired pressure in the system eas exceeded, the flow system was brought up to a pressure in the range of from about 1000 to about 2000 pounds per square inch gauge by argon or nitrogen entering the system through valve 80 and line 79. Then valve 80 was closed. Next, the pressure of the flow system was brought up to the desired reaction pressure by opening valve 53 and pumping water through Haskel pump 50 and line 51 into water tank 54. The water served to further compress the gas in the flow system and thereby to further increase the pressure in the system. If a greater volume of water than the volume of water tank 54 was needed to raise the pressure of the flow system to the desired level, then valve 61 was opened, and additional water was pumped through line 60 and into dump tank 44. When the pressure of the flow system reached the desired pressure, valves 53 and 61 were closed.

A Ruska pump 1 was used to pump the hydrocarbon fraction and water into pipe reactor 16. The Ruska pump 1 contained two 250-milliliter barrels (not shown), with the hydrocarbon fraction being loaded into one barrel and water into the other, at ambient temperature and atmospheric pressure. Pistons (not shown) inside these barrels were manually turned on until the pressure in each barrel equaled the pressure of the flow system. When the pressure in the barrels and in the flow system were equal, check valves 4 and 5 opened to admit hydrocarbon fraction and water from the barrels to flow through lines 2 and 3. At the same time, valve 72 was closed to prevent flow in line 70 between points 12 and 78. Then the hydrocarbon fraction and water streams joined at point 10 at ambient temperature and at the desired pressure, flowed through line 11, and entered the bottom 17 of pipe reactor 16. The reaction mixture flowed through pipe reactor 16 and exited from pipe reactor 16 through side arm 24 at point 20 in the wall of pipe reactor 16. Point 20 was 19 inches from bottom 17.

With solution flowing through pipe reactor 16, the furnace began heating pipe reactor 16. During heat-up of pipe reactor 16 and until steady state conditions were achieved, valves 26 and 34 were closed, and valve 43 was opened to permit the mixture in side arm 24 to flow through line 42 and to enter and be stored in dump tank 44. After steady state conditions were achieved, valve 43 was closed, and valve 34 was opened for the desired period of time to permit the mixture in side arm 24 to flow through line 33 and to enter and be stored in product receiver 35. After collecting a batch of product in product receiver 35 for the desired period of time, valve 34 was closed, and valve 26 was opened to permit the mixture in side arm 24 to flow through line 25 and to enter and be stored in product receiver 27 for another period of time. Then valve 26 was closed.

The material in side arm 24 was a mixture of gaseous and liquid phases. When such mixture entered dump tank 44, product receiver 35, or product receiver 27, the gaseous and liquid phases separated, and the gases exited from dump tank 44, product receiver 35, and product receiver 27 through lines 47, 38, and 30, respectively, and passed through line 70 and Annin valve 82 to a storage vessel (not shown).

When more than two batches of product were to be collected, valve 29 and/or valve 37 was opened to remove product from product receiver 27 and/or 35, respectively, to permit the same product receiver and/or receivers to be used to collect additional batches of product.

At the end of a run — during which the desired number of batches of product were collected — the temperature of pipe reactor 16 was lowered to ambient temperature, and the flow system was depressurized by opening valve 84, in line 85 venting to the atmosphere.

Diaphragm 76 measured the pressure differential across the length of pipe reactor 16. No solution flowed through line 85.

The API gravity of the liquid hydrocarbon products collected was measured, and their nickel, vanadium, and iron contents were determined by X-ray fluoresence.

of iron, and the amount of 300 parts per million was used to determine the percent iron removed from the product. The experimental conditions and characteristics of the products formed in these Examples are presented in Table 8. The liquid hourly space velocity (LHSV) was calculated by dividing the total volumetric flow rate, in milliliters per hour, of water and oil feed passing through pipe reactor 16 by the volumetric free space in pipe reactor 16 — that is, 6 milliliters.

The flow process employed in Examples 32–41 could also be modified so as to permit pumping a slurry of coal solids in a water-containing fluid through pipe reactor 16. In such case, the alundum balls would not be present in pipe reactor 16, and dump tank 44 and product receivers 27 and 35 could be equipped with some device, for example a screen, to separate the spent solids from the recovered liquid product. Thus, continuous and semi-continous flow processing could be used in the recovery process itself.

The above examples are presented by way of illustration, and the invention should not be construed as limited thereto. The various components of the catalyst system of the method of this invention do not possess exactly identical effectiveness. The most advantageous selection of these components and their concentrations and of the other reaction conditions will depend on the particular feed being processed.

We claim:

1. A process for recovering upgraded products from coal solids, comprising contacting the coal solids with a water-containing fluid, to thereby produce gases, liquids, and upgraded solids from the coal solids, under super-atmospheric pressure, at a temperature in the range of from about 600° F. to about 900° F. in the absence of externally supplied hydrogen or other reducing gas, and in the presence of an externally supplied, sulfur-resistant catalyst, selected from the group consisting of at least one basic metal carbonate, basic metal hydroxide, transition metal oxide, oxide-forming transition metal salt, and combinations thereof, wherein said catalyst is present in a catalytically effective amount, wherein the transition metal in the oxide

TABLE 8

| | Example 32 | Example 33 | Example 34 | Example 35 | Example 36 | Example 37 | Example 38 | Example 39 | Example 40 | Example 41 |
|---|---|---|---|---|---|---|---|---|---|---|
| Reaction pressure[1] | 4100 | 4040 | 4060 | 4080 | 4100 | 4100 | 4100 | 4100 | 4020 | 4040 |
| LHSV[2] | 1.0 | 1.0 | 1.0 | 1.0 | 2.0 | 2.0 | 2.0 | 2.0 | 2.0 | 2.0 |
| Oil-to-water volumetric flow rate ratio | 1:3 | 1:3 | 1:3 | 1:3 | 1:2 | 1:2 | 1:3 | 1:3 | 1:3 | 1:3 |
| Packing material | alundum | Ru, Ti | Ru, Ti | Ru, Ti | alundum | alundum | alundum | alundum | Ru, Ti | Ru, Ti |
| Product collected during period number[3] | 3 | 2 | 4 | 5 | 1 | 2 | 1 + 2 | 3 | 2 | 3 |
| Product characteristics API gravity[4] | 21.0 | 21.0 | 23.0 | 20.0 | 17.8 | 17.3 | 21.0 | 22.9 | 20.0 | 20.0 |
| Percent nickel removed | 95 | 77 | 84 | 69 | 97 | 69 | 64 | 69 | 69 | 93 |
| Percent vanadium removed | 97 | 81 | 96 | 99 | 59 | 54 | 73 | 59 | 60 | 77 |
| Percent iron removed | 98 | 99 | 98 | 92 | — | — | 99 | 99 | 98 | 98 |

[1]pounds per square inch gauge.
[2]hours$^{-1}$.
[3]The number indicates the 7–8 hour period after start-up and during which feed flowed through pipe reactor 16.
[4]° API.

The properties of the straight tar sands oil feed employed in Examples 32–41 are shown in Table 4. The tar sands oil feed contained 300–500 parts per million and salt is selected from the group consisting of a transition metal of Group IVB, VB, VIB, and VIIB of the Periodic Chart and the metal in the basic metal carbonate and hydroxide is selected from the group consisting of alkali metals, and wherein sufficient water is present in the water-containing fluid and said pressure is sufficiently high so that the water in the water-containing fluid has a density of at least 0.10 gram per milliliter and serves as an effective solvent for the liquids and gases produced from the coal solids; and lowering said temperature or pressure or both, to thereby make the water in the water-containing fluid a less effective solvent for such liquids and gases and to thereby form separate phases.

2. The process of claim 1 wherein the density of water in the water-containing fluid is at least 0.15 gram per milliliter.

3. The processs of claim 2 wherein the density of water in the water-containing fluid is at least 0.2 gram per milliliter.

4. The process of claim 1 wherein the temperature is at least 705° F.

5. The process of claim 1 wherein the coal solids and water-containing fluid are contacted for a period of time in the range of from about 1 minute to about 6 hours.

6. The process of claim 5 wherein the coal solids and water-containing fluid are contacted for a period of time in the range of from about 5 minutes to about 3 hours.

7. The process of claim 6 wherein the coal solids and water-containing fluid are contacted for a period of time in the range of from about 10 minutes to about 1 hour.

8. The process of claim 1 wherein the weight ratio of coal solids-to-water in the water-containing fluid is in the range of from about 3:2 to about 1:10.

9. The process of claim 8 wherein the weight ratio of coal solids-to-water in the water-containing fluid is in the range of from about 1:1 to about 1:3.

10. The process of claim 1 wherein the water-containing fluid is substantialaly water.

11. The process of claim 1 wherein the water-containing fluid is water.

12. The process of claim 1 wherein the coal solids have a maximum particle size of one-half inch diameter.

13. The process of claim 12 wherein the coal solids have a maximum particle size of one-quarter inch diameter.

14. The process of claim 13 wherein the coal solids have a maximum particle size of 8 mesh.

15. The process of claim 1 wherein the water-containing fluid contains an organic material selected from the group consisting of biphenyl, pyridine, a highly saturated oil, an aromatic oil, a partly hydrogenated aromatic oil, and a mono- or polyhydric compound.

16. The process of claim 15 wherein the water-containing fluid contains an organic material selected from the group consisting of biphenyl, pyridine, a highly saturated oil, and a mono- or polyhydric compound.

17. The process of claim 16 wherein the water-containing fluid contains a highly saturated oil.

18. The process of claim 1 wherein the transition metal in the oxide and salt is selected from the group consisting of vanadium, chromium, manganese, titanium, molybdenum, zirconium, niobium, tantalum, rhenium, and tungsten.

19. The process of claim 18 wherein the transition metal in the oxide and salt is selected from the group consisting of chromium, manganese, titanium, tantalum, and tungsten.

20. The process of claim 1 wherein the metal in the basic metal carbonate and hydroxide is selected from the group consisting of sodium and potassium.

21. The process of claim 1 wherein the catalyst is present in a catalytically effective amount which is equivalent to a concentration level in the water in the water-containing fluid in the range of from about 0.01 to about 3.0 weight percent.

22. The process of claim 21 wherein the catalyst is present in a catalytically effective amount which is equivalent to a concentration level in the water in the water-containing fluid in the range of from about 0.10 to about 0.50 weight percent.

* * * * *

UNITED STATES PATENT OFFICE

CERTIFICATE OF CORRECTION

Patent No. 3,988,238 Dated October 26, 1976

Inventor(s) John D. McCollum et al.

It is certified that error appears in the above-identified patent and that said Letters Patent are hereby corrected as shown below:

Column 8, line 26, "wight" should be -- weight --.

" 14, " 49, "approximately" should be -- Approximately --.

" 18, " 30, "eas" should be -- was --.

" 18, " 56, "pressure" should be -- pressures --.

" 21, " 40, "substantialaly" should be -- substantially --.

Signed and Sealed this

Fifteenth Day of March 1977

[SEAL]

*Attest:*

RUTH C. MASON
*Attesting Officer*

C. MARSHALL DANN
*Commissioner of Patents and Trademarks*